US008671802B2

(12) United States Patent
Takagi

(10) Patent No.: US 8,671,802 B2
(45) Date of Patent: Mar. 18, 2014

(54) BOTTLE CAP OPENER

(71) Applicant: Chikamitsu Takagi, Osaka (JP)

(72) Inventor: Chikamitsu Takagi, Osaka (JP)

( * ) Notice: Subject to any disclaimer, the term of this patent is extended or adjusted under 35 U.S.C. 154(b) by 0 days.

(21) Appl. No.: 13/873,997

(22) Filed: Apr. 30, 2013

(65) Prior Publication Data

US 2013/0312573 A1 Nov. 28, 2013

(30) Foreign Application Priority Data

May 22, 2012 (JP) ..... 2012-116545

(51) Int. Cl.

| | |
|---|---|
| ***B67B 7/14*** | (2006.01) |
| ***B67B 7/18*** | (2006.01) |
| ***B67B 7/16*** | (2006.01) |
| ***B65B 7/16*** | (2006.01) |
| ***B67B 7/00*** | (2006.01) |

(52) U.S. Cl.

USPC ..... 81/3.56; 81/3.33; 81/3.27; 81/3.35; 81/3.37; 81/3.4; 81/3.55; 7/151; 7/154; 7/155; 7/156

(58) Field of Classification Search

USPC ..... 81/3.56, 3.27, 3.35, 3.4–3.55, 81/3.47–3.48; 7/151, 154–156

See application file for complete search history.

(56) References Cited

U.S. PATENT DOCUMENTS

| | | | | |
|---|---|---|---|---|
| 2,155,947 | A * | 4/1939 | Low | 81/3.55 |
| 3,570,027 | A * | 3/1971 | Steiner | 7/152 |
| 4,464,866 | A * | 8/1984 | Smith et al. | 451/5 |
| 7,069,813 | B2 * | 7/2006 | Cheung | 81/3.37 |
| 2005/0252344 | A1 * | 11/2005 | Wang | 81/3.55 |
| 2007/0107555 | A1 * | 5/2007 | Zhou | 81/3.37 |
| 2009/0133537 | A1 | 5/2009 | Uglum | |

FOREIGN PATENT DOCUMENTS

| | | |
|---|---|---|
| GB | 2193194 A | 2/1988 |
| JP | 2-219786 | 9/1990 |
| WO | 03/089362 A1 | 10/2003 |

OTHER PUBLICATIONS

Extended European Search Report for European Application No. 13168040.7, dated Sep. 13, 2013.

* cited by examiner

*Primary Examiner* — Monica Carter

*Assistant Examiner* — Danny Hong

(74) *Attorney, Agent, or Firm* — Birch, Stewart, Kolasch & Birch, LLP

(57) ABSTRACT

A movable outer cylindrical member and a movable inner cylindrical member are arranged vertically movably in a lower half of a cylindrical main body. By placing the movable inner cylindrical member on a bottle mouth and pushing down the cylindrical main body, a lower end of a hooking member is engaged with a lower end of the crown cap to pry the crown cap away. At the same time, the movable outer cylindrical member is moved up and a piston inside a cylinder arranged in an upper half of the cylindrical main body is moved up with the movable outer cylindrical member, so that the air in the cylinder is compressed, and a cover member is brought out in by the compressed air.

12 Claims, 8 Drawing Sheets

BOTTLE CAP OPENER

FIELD OF THE INVENTION

The present invention relates to a bottle cap opener for prying off a crown cap which seals a bottle mouth, by placing the bottle cap opener on a mouth of a bottle filled with soft drink, juice, beer or the like and then by pushing the same down, and for simultaneously generating a sound of opening of the cap.

BACKGROUND OF THE INVENTION

A bottle cap opener configured to pry a crown cap off a bottle mouth by placing the bottle cap opener on the mouth of the bottle like a beer bottle, which is sealed with the crown cap, and then by pushing it down is described in the Patent Document 1, for example.

As shown in FIG. 8, the bottle cap opener comprises an outer cylindrical body 51 of which the lower end is fully opened and the upper end is closed with a cover body 51*a*, and an inner cylindrical body 52 inserted in the outer cylindrical body 51 in a vertically movable manner. An opening mechanism for opening the crown cap A sealing the bottle mouth B is arranged in the inner cylindrical body 52. The inner cylindrical body 52 is inhibited from coming out of the outer cylindrical body 51.

The opening mechanism comprises a lever 53 pivotally fitted to an upper end part of the inner cylindrical body 52 in a vertically rotatable manner, a crown cap hooking member 54 of which an upper end is pivotally fitted to a front end of the lever 53 directed to an end of the inner cylindrical body 52 so that it may swing in a diameter direction of the inner cylindrical body 52, a crown cap hooking claw 54*a* arranged at a lower end of an inside of the crown cap hooking member 54, a wall part 55 arranged integrally with the inner cylindrical body 52 in a space below the lever 53 and provided with a projection 55*a* arranged on a lower surface thereof to receive the other end of a top surface of the crown cap, a spring 56 urging a base end side of the lever 53 upward at all times, a spring 57 urging a lower end of the crown cap hooking member 54 inward at all times, and a receiving member 58 projecting downward from a lower surface of the other end of a cover body 51*a* of the outer cylindrical body 51 to receive the base end of the lever 53 with a lower end surface thereof.

According to the bottle cap opener provided with the opening mechanism which is thus configured, the crown cap A can be easily opened as follows. First, the inner cylindrical body 52 is placed on the mouth of the bottle sealed by the crown cap A, and the other end of the top surface of the crown cap A is allowed to come into contact with and to be received by the projection 55*a* of the wall part 55. When the outer cylindrical body 51 is pushed down from this state, the base end of the lever 53 is pushed down by the receiving member 58 projecting downward from the other end of the outer cylindrical body 51, while the crown cap hooking member 54 pivotally fitted to the front end of the lever 53 is moved up and the crown cap hooking claw 54*a* at the lower end is moved along the mouth surface of the bottle B, so that the crown cap hooking claw 54*a* is engaged with a lower end of an end side of the crown cap A. The crown cap hooking member 54 is moved up further from the engaged state, and the crown cap A can be easily pried off the end part side, with the projection 55*a* of the wall part 55 serving as a fulcrum.

DOCUMENT OF THE PRIOR ART

Patent Document (Patent Document 1)
Publication of Unexamined Patent Application H2-219786

DISCLOSURE OF THE INVENTION

Problem to be Solved

According to the bottle cap opener which is configured as mentioned above, the crown cap can be taken away from the bottle mouth without flicking it around. However, the crown cap is pried off the bottle mouth from an end to the other end of the crown cap without opening the same instantly and vigorously, by the pushing-down force of the outer cylindrical body 51 which force moves up the crown cap hooking member 54 having the hooking claw 54*a* engaged with the crown cap from the bottle mouth. Therefore, a touch of completion of the opening of the crown cap is hardly transmitted to the hand pressing down the outer cylindrical body 51 and opening the crown cap. In addition, a brisk sound of "pop" usually generated upon vigorously removing a crown cap is not generated since the air in the bottle is released outside when part of the crown cap comes off from the bottle mouth. Therefore, performance of bringing additional excitement for enhancing atmosphere of a party etc. cannot be expected.

SUMMARY OF THE INVENTION

The present invention has been made in view of the above-mentioned problem. A purpose of the present invention is to provide a bottle cap opener by which not only a crown cap which seals a bottle mouth is easily opened but also a touch or a feeling is obtained upon completion of opening of the crown cap. Further, a light sound of opening, which is comparable to the one generated upon pulling out a champagne cork, is generated, so that the ambient atmosphere can be enhanced.

To achieve the above-mentioned purpose, the bottle cap opener of this invention claimed in claim 1 comprises a cylindrical main body; a movable outer cylindrical member arranged in a lower half of the cylindrical main body in a vertically movable manner; a movable inner cylindrical member arranged inside the movable outer cylindrical member in a vertically movable manner, and having an opening part formed in a lower end thereof to receive a bottle mouth and a top wall formed on an upper end thereof which top wall having a projection to receive a top surface of the crown cap; a lever supported on the movable inner cylindrical member in a vertically swingable manner above the top wall; a hooking member of which an upper end is pivotally fitted to an end of the lever in an inward and outward swingabe manner, and a lower end has a hooking claw engageable with the crown cap; a receiving member arranged on the other end side part in the movable outer cylindrical member to receive an upper surface of the other end of the lever with a lower end surface thereof; a spring urging the other end of the lever upward at all times to press the upper surface of the other end of the lever against a lower end surface of the receiving member; a cylinder arranged in an upper half of the cylindrical main body and having an open upper end; a piston fitted in the cylinder and moved up and down integrally with the movable outer cylindrical member; a cover member detachably fitted into an upper end opening part of the cylinder, brought out upward, when a frictional force between the cylinder and the cover member is overcome, by the pressure of the air inside the cylinder compressed by the piston which is moved upward upon opening operation of the crown cap, and generating a sound by letting the compressed air out from the inside of the cylinder when the cover member is brought out; and a spring urging the movable outer cylindrical member downward against the cylinder at all times.

In the bottle cap opener which is thus configured, the invention claimed in claim 2 is as follows. Namely, an upper end part of a rod body is integrally fixed to a center part of a lower surface of the piston arranged in the cylinder in a vertically slidable manner. A lower end part of the rod body penetrates a center part of a bottom surface plate closing up a lower end opening part of the cylinder, and is fixed to a top wall part of the movable outer cylindrical member. The piston and the movable outer cylindrical member are integrally connected with each other by the rod body.

In the invention claimed in claim 3, the cover member arranged in an upper end opening part of the cylinder comprises a cover plate part, a ring-shaped peripheral wall part projecting downward from an outer periphery of the cover plate part, and leg elements having a predetermined length and vertically arranged downward on a lower end of the ring-shaped peripheral wall part at predetermined intervals in a peripheral direction. An outer peripheral surface of the ring-shaped peripheral wall part and an outer surface of the leg elements are in tight contact with an inner peripheral surface of the upper end opening part of the cylinder under a predetermined frictional force.

In the invention claimed in claim 4, a fixed top plate is fixed to an upper end opening part of the cylindrical main body. A plurality of vent holes are formed in an outer peripheral part of the fixed top plate in a penetrating manner, and a short cylindrical stopper is formed on a lower surface thereof in a projecting manner to receive the cover member coming out upward from the cylinder upon opening of the crown cap and to inhibit the whole cover member from separating upward from the cylinder.

In the invention claimed in claim 5, a pushing-back member is arranged on an upper end of the cylindrical main body to fit the cover member coming out upward from the cylinder back into an upper end part of the cylinder, and a supporting hole is formed in the center part of the fixed top plate for insertion and support of the pushing-back member in a vertically movable manner.

The bottle cap opener claimed in claim 6 relates to a preferred configuration of the pushing-back member which comprises a head part fitted into the supporting hole formed in the center of the fixed top plate of the cylindrical main body, and a shaft part made to project its lower end from a lower surface of the head part downward through the stopper projecting from the lower surface of the fixed top plate, and a lower end of the shaft part is connected with the center part of the upper surface of the cover member in an integrating manner.

Advantages of the Invention

According to the invention claimed in claim 1, the movable inner cylindrical member arranged in the lower half of the cylindrical main body is placed, by holding the cylindrical main body, on a mouth of a bottle sealed with the crown cap, by which the top surface of the crown cap is brought into contact with and received by the projection projecting from the top wall part of the movable inner cylindrical member, and the hooking claw of the hooking member is engaged with a lower end of the crown cap. When the cylindrical main body is pushed down from this state, the hooking member is moved up by the intermediary of the lever whose upper surface is in contact with the receiving member arranged on the other end side of the movable outer cylindrical member, so that the crown cap is opened easily with the projection, which receives the top surface of the crown cap, serving as a fulcrum.

Further, the cylinder having the piston fitted therein is arranged in the upper half of the cylindrical main body. The cover member which is brought out of the opening end of the cylinder when the compressed air pressure generated in the cylinder is applied is fitted into the upper end opening of the cylinder. In addition, the piston is configured so that it can move up and down integrally with the movable outer cylindrical body arranged in the lower half of the cylindrical main body. Consequently, when the crown cap is opened by the hooking member while the cylindrical main body is pushed down, the piston is moved upward, so that the air in the upper part of the cylinder is compressed by the movable outer cylindrical member relatively moving up in reaction to the pushing down of the cylindrical main body. When the pressure of the compressed air overcomes the frictional force between the cylinder and the cover member, the cover member separates from the upper end of the cylinder in the upper direction in a moment, and the compressed air in the cylinder is released at a burst. Consequently, the force pressing down the cylindrical main body is released instantaneously whereby the touch or the feeling of completion of opening of the crown cap is transmitted to the hand holding the cylindrical main body, and a brisk cap-opening sound of "pop" comparable to the one generated upon pulling out a cork of champagne is generated by the vigorous release of the compressed air, so that exciting atmosphere of a party etc. is enhanced.

In addition, when the cylindrical main body is lifted relatively to the mouth of the bottle after the crown cap is opened, the movable outer cylindrical member is automatically returned to its initial position by a restoring force of the spring urging the movable outer cylindrical member downward at all times, and the lever and the hooking member are returned to their initial positions by the restoring force of the spring urging the other end part of the lever upward at all times. Further, the movable inner cylindrical member is also returned to its initial position relatively to the movable outer cylindrical member to be ready for the following opening operation of the crown cap.

According to the invention claimed in claim 2, the piston and the movable outer cylindrical member are connected to each other by a rod body of the piston fitted in the cylinder so that they can be integrally moved up and down. Consequently, the upward movement of the movable outer cylindrical member is transmitted to the piston surely by the simple configuration, and the air in the upper part of the cylinder is compressed to a predetermined pressure level smoothly.

According to the invention claimed in claim 3, the cover member arranged on the upper end opening part of the cylinder comprises the cover plate part, the ring-shaped peripheral wall part projecting downward from the outer periphery of the cover plate part, and the leg elements having a predetermined length and vertically arranged downward on a lower end of the ring-shaped peripheral wall part at predetermined intervals in a peripheral direction thereof. The outer peripheral surface of the ring-shaped peripheral wall part and the outer surface of the leg elements are in close contact with the inner peripheral surface of the upper end opening part of the cylinder under a predetermined frictional force. Consequently, the cover member can slide precisely in a vertically stable posture while the plurality of leg elements vertically arranged on the outer periphery of the cover plate part are in uniform slide contact with the inner peripheral surface of the cylinder. Further, by applying the compressed air, which is generated by the upward movement of the piston in the upper part of the cylinder upon opening of the bottle, to the whole lower surface of the cover plate part evenly, the cover plate part of the cover member is brought out of the cylinder upward, smoothly and instantaneously.

Further, when the cover plate part is separated upward from the cylinder, the space between upper end parts of the mutually adjacent leg elements comes out of the cylinder, and the compressed air in the cylinder is discharged outside from the space in a moment. Therefore, even after the crown cap is opened, the parts of the leg elements corresponding to the length and other than the upper end part of the leg elements stay in slide contact with the inner surface of the cylinder. Consequently, the cover member can be easily and precisely pushed back to the initial closing state while the leg elements serve as a guide so that the bottle cap opener may become ready for the following service.

According to the invention claimed in claim 4, the fixed top plate is fixed to the upper end opening part of the cylindrical main body, and a plurality of vent holes are formed in the outer peripheral part of the fixed top plate. Consequently, the sound of opening of the crown cap generated in the upper half of the cylindrical main body is allowed to leak outside through the vent holes whereby the sound of opening is transmitted outside to be heard clearly. Furthermore, a short cylindrical stopper is arranged on a lower surface of the fixed top plate in a projecting manner to receive the cover member which comes out upward from the cylinder upon opening of the crown cap and to inhibit the whole cover member from separating upward from the cylinder. Consequently, the leg elements vertically arranged on the outer periphery of the cover plate part stay in the cylinder even when the cover member is brought out of the upper end opening of the cylinder vigorously by the compressed air pressure generated in the cylinder, whereby preparation for following opening operation of the crown cap can be made easily.

According to the invention claimed in claim 5, the pushing-back member is arranged on an upper end of the cylindrical main body to fit and restore the cover member, which comes off upward from the cylinder upon opening of the crown cap, back into an upper end part of the cylinder, and the supporting hole is formed in the center part of the fixed top plate to insert and support the pushing-back member in a vertically movable manner. When the cover member comes out upward from the upper end opening part of the cylinder upon opening of the crown cap, the pushing-back member is protruded upward from the fixed top plate by the upward movement of the cover member. Consequently, by pushing down the pushing-back member back into the cylindrical main body after opening of the crown cap, the cover member can be easily inserted and restored into the upper end opening part of the cylinder.

Furthermore, according to the invention claimed in claim 6, the pushing-back member comprises a head part fitted to the supporting hole formed in the center of the fixed top plate of the cylindrical main body, and a shaft part projecting downward from the lower surface of the head part. The shaft part is made to project its lower end downward through the stopper projecting from the lower surface of the fixed top plate, and the lower end of the shaft part is connected with the center part of the upper surface of the cover member in an integrating manner. The head part of the pushing-back member is engaged with the supporting hole formed in the center part of the fixed top plate and the shaft part thereof is housed in the cylindrical main body before opening operation of the crown cap, whereby not only the pushing-back member is prevented from being damaged etc. but also it is known that the bottle cap opener is ready for the opening operation of the crown cap. After the crown cap is opened, the head part of the pushing-back member projecting from the fixed top plate is pushed downward by which the cover member connected to the lower end of the shaft part can be easily inserted and fitted into the upper end opening part of the cylinder.

In addition, after the opening operation, in the case that the pushing-back member is found to be protruded upward from the fixed top plate of the cylindrical main body though the piston and the movable inner and outer cylindrical members are automatically returned to their initial positions to be ready for the following opening operation, it is known that the cover member is not inserted and fitted into the upper end opening part of the cylinder. In the meantime, even when the cover member is not inserted and fitted into the upper end opening part of the cylinder, the piston and the movable inner and outer cylindrical members are automatically returned to their initial positions. Therefore the crown cap can be opened though the sound is not made.

EMBODIMENTS OF THE INVENTION

Figure 1:
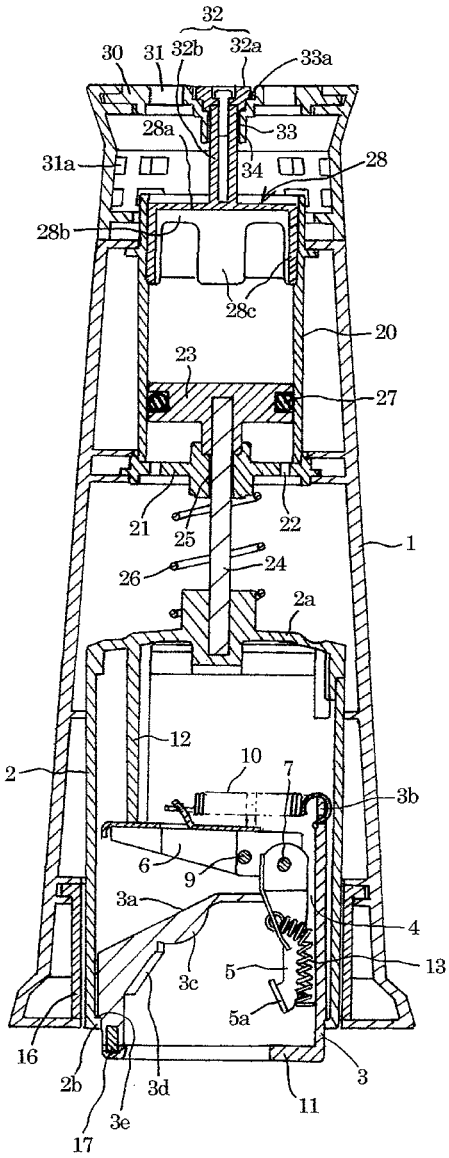
FIG. 1 is a vertically sectioned side view of the bottle cap opener.
Figure 2:
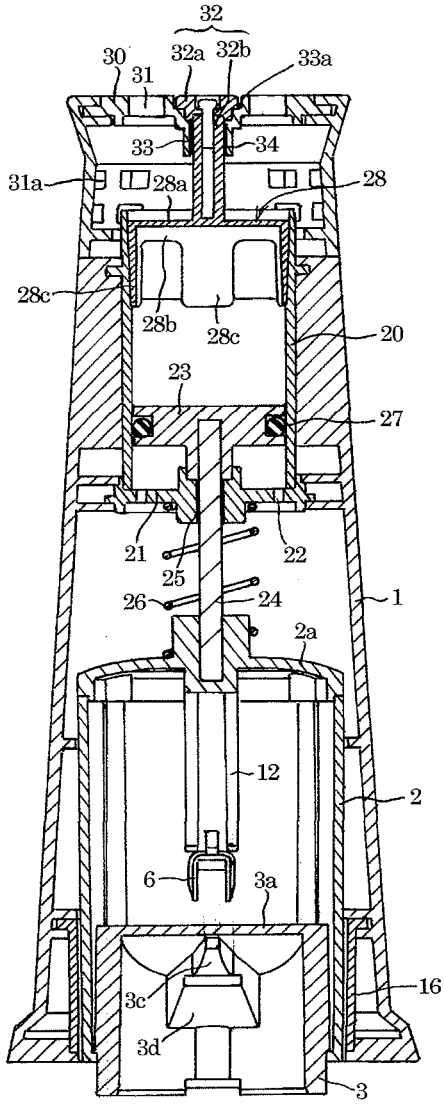
FIG. 2 is a vertically sectioned front view of the bottle cap opener.
Figure 3:
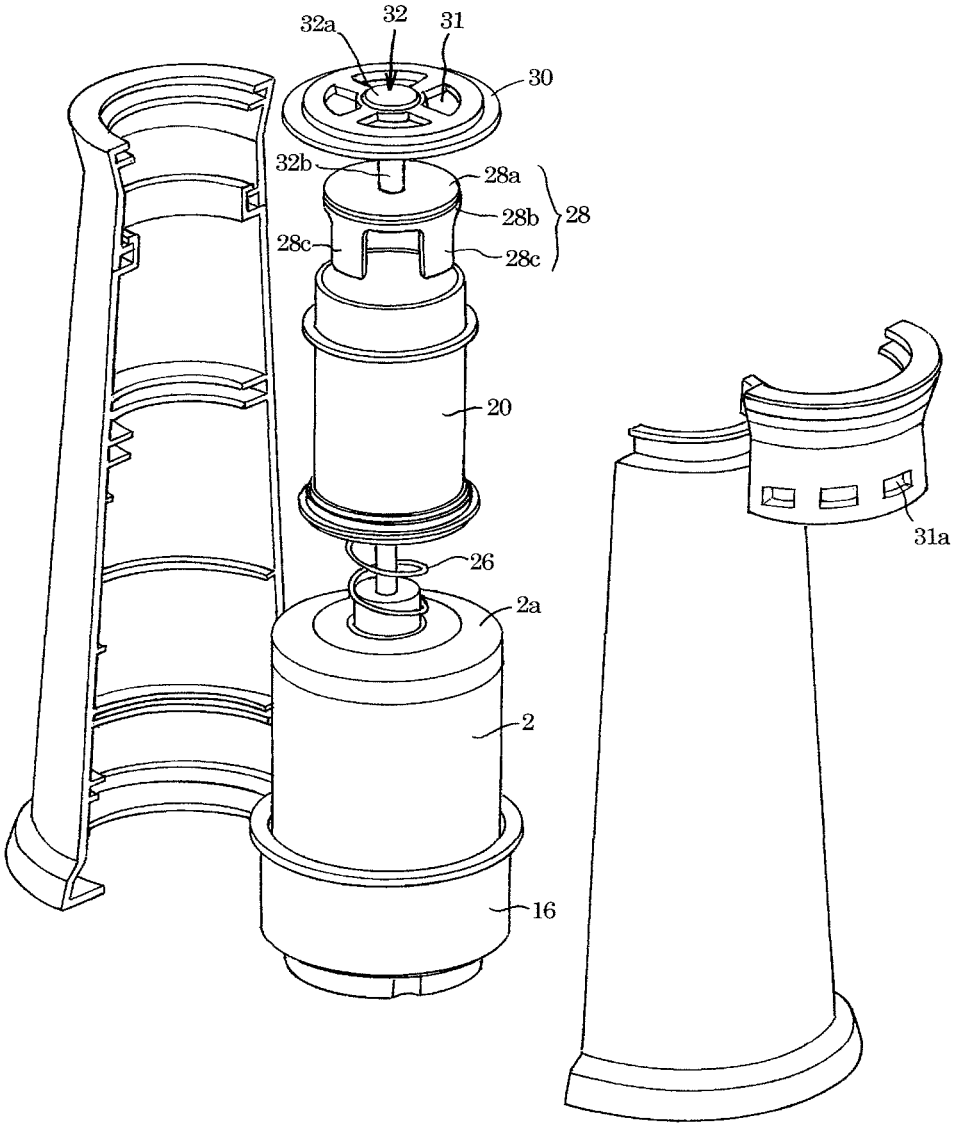
FIG. 3 is a perspective view showing an inside structure shown by splitting the cylindrical main body.

A specific example of an embodiment of the present invention is explained hereinafter based on the drawings. As shown in FIGS. 1 to 4, a body of the bottle cap opener comprises a cylindrical main body 1 formed into a vertically long cylindrical shape. A cap opening mechanism is arranged in a lower half of the cylindrical main body 1 to open a crown cap A sealing a bottle mouth B as shown in FIG. 5. A sound generating mechanism is arranged in an upper half of the cylindrical main body 1 to generate a brisk sound of "pop" like the one generated upon pulling out a cork of champagne, being operatively linked with opening of the crown cap A. Specific structures of the cap opening mechanism and the sound generating mechanism will be described later.

A movable outer cylindrical member 2 is arranged in the lower half of the cylindrical main body 1 in a vertically movable manner. An upper end opening part of the movable outer cylindrical member 2 is closed by a top wall part 2*a* and a lower end thereof is fully opened. A movable inner cylindrical member 3 provided with the cap opening mechanism is arranged in the movable outer cylindrical member 2 in a vertically movable manner.

The movable inner cylindrical member 3 is shorter than the movable outer cylindrical member 2 in length, and is arranged in the lower half of the movable outer cylindrical member 2. A top wall part 3*a* is arranged on the upper end of the movable inner cylindrical member 3. A half of an upper surface of the top wall part 3*a* is formed to be a horizontal surface, and the other half thereof is formed to be an inclined surface inclining obliquely downward. A hole 4 is formed in an end part of the horizontal surface of the top wall part 3*a* in a vertically penetrating manner. A hooking member 5 is provided with a hooking claw 5*a* at a lower end thereof so that the hooking claw 5*a* may be engaged with the crown cap A. The hooking member 5 is inserted into the hole 4, and an upper end of the hooking member 5 projecting upward from the hole 4 is pivotally fitted to an end of a lever 6, which is arranged above the top wall part 3*a*, by a pin 7 so that it can swing inward and outward.

Figure 4:
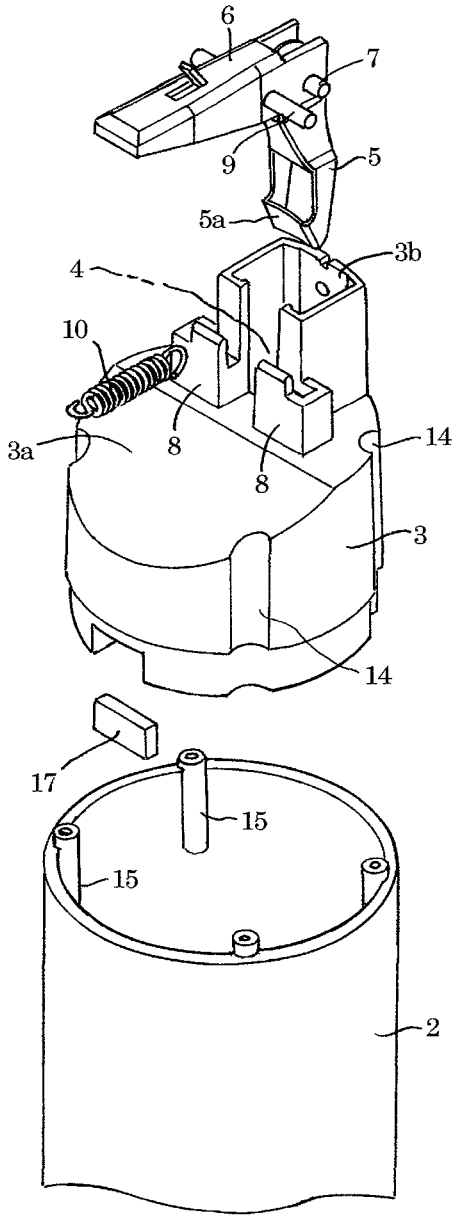
FIG. 4 is an exploded perspective view of the lever, the movable inner cylindrical member and the movable outer cylindrical member.
Figure 5:
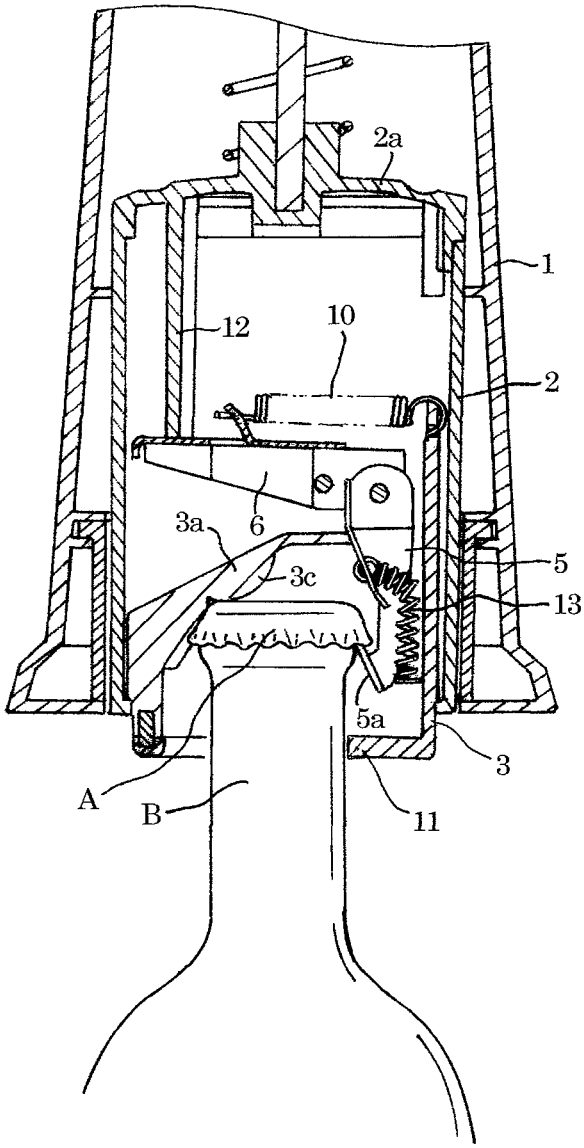
FIG. 5 is a vertically sectioned side view of an essential part in the state that the movable inner cylindrical member is placed on the bottle mouth.

As shown in FIG. 4, a pair of shaft bearing elements 8, 8 are arranged in a projecting manner at a predetermined interval on both peripheral wall edge sides of an upper surface of the horizontal surface of the top wall part 3*a* of the movable inner cylindrical member 3. The shaft bearing elements 8, 8 support a front end of the lever 6, which extends to another peripheral side end of the movable inner cylindrical member 3, in a vertically rotatable manner by means of a pin 9.

In the lever 6, the length of the pin 9, which is supported by the bearing element 8, 8, from the pin 9 to the front end thereof, is formed longer than the length from the pin 9 to a base end extending to the other side of the movable inner cylindrical member 3. An upper surface of the base end of the lever 6 and an upper end of a projection 3*b* projecting upward from an end of the top wall part 3*a* of the movable inner cylindrical member 3 are connected to each other by a tension spring 10, so that the base end side of the lever 6 is urged in the upward rotational direction around the pin 9 at all times by the tensile force of the tension spring 10.

A lower end opening part of the movable inner cylindrical member 3 is formed to have the size that can accept the bottle mouth B, and a bottle mouth receiving projection 11 is arranged to project inward from a side of an opening edge thereof to receive part of an outer peripheral surface of the bottle mouth B. Further, a projection 3C is arranged to project downward on a lower surface of the inclined upper surface of the top wall part 3*a* of the movable inner cylindrical member 3 to receive the other end part of a top surface of the crown cap A sealing the bottle mouth B. A crown cap supporting wall 3*d* is formed on the lower surface of the other end part of the top wall part 3*a* and adjacently to the projection 3 *c*, which projects downward, to receive a peripheral part of the crown cap A. The crown cap supporting wall 3*d* is arranged to face the hooking claw 5*a* of the hooking member 5 arranged in the other end part of the movable inner cylindrical member 3.

Furthermore, a receiving member 12 receiving an upper surface of the base end of the lever 6 is arranged to project downward from a lower surface of the other end part of the top wall part 2*a* of the movable outer cylindrical member 2. The upper surface of the base end of the lever 6 urged upward by the tensile force of the tension spring 10 is received by a lower end surface of the receiving member 12 at all times. A spring 13 like a leaf spring or a coil spring is fitted in a space between the hooking member 5 and an inner surface of the other end part of the movable inner cylindrical member 3. Elasticity of the spring 13 urges the hooking claw 5*a* of the hooking member 5 inward to the position where the hooking claw 5*a* can be engaged with a lower end of the crown cap A.

The cap opening mechanism comprises the receiving member 12 projecting from the lower surface of the other end part of the top wall part 2*a* of the movable outer cylindrical member 2, the hooking member 5, the lever 6, the projection 3 *c* projecting on a lower surface of the other end part of the top wall part 3*a* of the movable inner cylindrical member 3, the tension spring 10, and the spring 13. In the meantime, vertical channels 14 are formed at a plurality of positions of an outer peripheral surface of the movable inner cylindrical member 3 over the whole length as shown in FIG. 4. The vertical channels 14 are engaged with guiding linear projections 15 arranged vertically at a plurality of positions of the inner peripheral surface of the movable outer cylindrical member 2 in a vertically slidable manner so that the movable inner cylindrical member 3 is prevented from moving randomly in the peripheral direction, and that the state is maintained where the upper surface of the base end part of the lever 6 abuts on the lower end surface of the receiving member 12 on the side of the movable outer cylindrical member 2 at all times. At the same time, a guiding cylindrical body 16 is fitted to an inner peripheral surface of a lower end part of the cylindrical main body 1 so that the movable outer cylindrical member 2 can be moved up and down along the inner peripheral surface of the guiding cylindrical body 16.

A projecting edge part 2*b* is formed on an inner peripheral surface of a lower end opening of the movable outer cylindrical member 2, while a cutout step part 3*e* engaged with the projecting edge part 2*b* is formed in the lower end part of the outer peripheral surface of the movable inner cylindrical member 3, so that the movable inner cylindrical member 3 is prevented from coming out downward from the movable outer cylindrical member 2. In addition, a magnet element 17 is fitted to the other end part of a lower end opening part of the movable inner cylindrical member 3 so that the crown cap A removed from the bottle mouth B by the cap opening mechanism can be attracted and held.

A cylinder 20 is fitted and fixed in an upper half of the cylindrical main body 1. An upper end of the cylinder 20 is fully open, while a lower end opening thereof is closed by a bottom surface plate 21 having vent holes 22 in the outer peripheral part. A piston 23 is arranged in the cylinder 20 in a vertically slidable manner. An upper end part of a rod body 24 is fixed to a center part of a lower surface of the piston 23. The rod body 24 projects downward penetrating a through hole 25 formed in a center part of the bottom surface plate 21 of the cylinder 20. A lower end part of the rod body 24 is fixed to a center part of the top wall part 2*a* of the movable outer cylindrical member 2. Consequently, the piston 23 and the movable outer cylindrical member 2 are configured to be movable together up and down by the intermediary of the rod body 24.

A coil spring 26 is interposed between opposite surfaces of the bottom surface plate 21 of the cylinder 20 and the top wall part 2*a* of the movable outer cylindrical member 2 in a compressed state. An upper end of the coil spring 26 is supported by the center part of the lower surface of the bottom surface plate 21 of the cylinder 20, and a lower end of the same is supported by the center part of the upper surface of the top wall part 2*a* of the movable outer cylindrical member 2. Consequently, the movable outer cylindrical member 2 is urged downward at all times by an elastic force of the coil spring 26. In the meantime, an O ring 27 is pressure fitted to an outer peripheral surface of the piston 23 in a slidable manner on an inner peripheral surface of the cylinder 20.

A cover member 28 is detachably fitted into an upper end opening part of the cylinder 20 in an attachable and detachable manner. The cover member 28 includes a disc-shaped cover plate part 28*a* having a predetermined thickness, a ring-shaped peripheral wall part 28*b* projecting downward from an outer peripheral end of the cover plate part 28*a*, and a plurality of leg elements 28*c* having a predetermined length and arranged vertically downward on a lower end of the ring-shaped peripheral wall part 28*b* at predetermined intervals in the peripheral direction. The cover plate part 28*a* and the ring-shaped peripheral wall part 28*b* have the same diameter, and the outer peripheral surfaces thereof are fitted on an upper end part of an inner peripheral surface of the cylinder 20 in a manner that they can come out of the cylinder 20 in the upper direction. An outer surface of the plurality of leg elements 28*c* arranged vertically downward from the lower end of the ring-shaped peripheral wall part 28*b* is curved in the peripheral direction into a projecting arc shape in the curvature same as that of the inner peripheral surface of the cylinder 20 so that it may thoroughly be in slide contact with the inner peripheral surface of the cylinder 20, and the outer surface thereof is brought into close contact with the inner peripheral surface of the cylinder 20 together with the cover plate part 28*a* and the ring-shaped peripheral wall part 28*b* under a predetermined frictional force.

The piston 23 moves upward to compress the air between a lower surface of the cover member 28 and the upper surface of the piston 23 in the cylinder 20. When the compressed air pressure overcomes the frictional force between the cover member 28 and the cylinder 20, the compressed air pressure allows the cover member 28 to come out of the upper end of the cylinder 20 in the upper direction in a moment and the compressed air in the cylinder 20 is discharged instantaneously, by which the sound of "pop" is emitted. Thus, the piston 23 fitted in the cylinder 20 and the cover member 28 fitted into the upper end opening part of the cylinder 20 with the predetermined frictional force configure the sound generating mechanism which generates an imitative sound for the one generated upon opening of a bottle cap.

A disk-shaped fixed top plate 30 is fixed to the upper end opening part of the cylindrical main body 1, and the upper end opening part of the cylindrical main body 1 is closed by the fixed top plate 30. A plurality of vent holes 31 with an arbitrary size are formed in a penetrating manner through the upper and lower surfaces of the outer peripheral part of the fixed top plate 30. A supporting hole 33 is formed in the center part of the fixed top plate 30 for vertically movably inserting and supporting a pushing-back member 32 pushing and restoring the cover member 28 to its initial closing position when the cover member 28 comes out of the upper end opening part of the cylinder 20 in the upper direction. An upper part of the supporting hole 33 is formed to be a larger-diameter hole part, and a lower part thereof is formed to be a smaller-diameter hole part. The supporting hole 33 has a ring-shaped supporting surface 33*a* formed on a lower end of the larger-diameter hole part. In the meantime, vent holes 31*a* are formed also at a plurality of positions of an upper end part of a peripheral wall surface of the cylindrical main body 1.

The pushing-back member 32 comprises a head part 32*a* and a shaft part 32*b*. The head part 32*a* is fitted to the larger-diameter hole part of the supporting hole 33, and a lower surface of the head part 32*a* is received by the supporting surface 33*a* of the larger-diameter hole part. The shaft part 32*b* having a predetermined length projects downward from a center part of a lower surface of the head part and penetrates the smaller-diameter hole part of the supporting hole 33. A lower end of the shaft part 32*b* is connected to the center part of the upper surface of the cover member 28 of the cylinder 20 in an integrating manner. The length of the shaft part 32*b* is determined so that the cover member 28 may be completely fitted into the upper end opening part of the cylinder 20 in the state that the head part 32*a* is fitted into and supported by the supporting hole 33. In the meantime, the shaft part 32*b* of the pushing-back member 32 and the cover member 28 are formed into one in this embodiment, however, these two members can be formed separately, in which case the lower end of the shaft part 32*b* is brought into contact with the center part of the upper surface of the cover member 28.

Furthermore, a short cylindrical stopper 34 is arranged to project downward from the center part of a lower surface of the fixed top plate 30 in a manner of surrounding an upper part of the shaft part 32*b* of the pushing-back member 32 penetrating the supporting hole 33. A lower part of the shaft part 32*b* of the pushing-back member 32 projects downward from a lower end surface of the stopper 34. A vertical interval between the lower end surface of the stopper 34 and the upper surface of the cover member 28 closing the upper end opening part of the cylinder 20 is formed to be longer than the thickness or the length between the upper surface of the cover member 28 and a lower end surface of the ring-shaped peripheral wall part 28*b*, and to be shorter than the length from the upper surface of the cover member 28 to the lower end part of the leg elements 28*c*, so that a lower part of the leg elements 28*c* stays in contact with an inside of the cylinder 20 when the cover member 28 comes out of the upper end opening part of the cylinder 20 upon opening of the bottle cap.

Now, operation of the bottle cap opener which is configured as mentioned above is explained hereinafter. Namely, the cylindrical main body 1 is held and the movable inner cylindrical member 3 arranged in the lower half of the cylindrical main body 1 is placed on the bottle mouth B sealed by the crown cap A. When the cylindrical main body 1 is pushed down while an end part side of the outer peripheral surface of the bottle mouth B is allowed to slide on the receiving projection 11 projecting inward from the side of the lower end opening of the movable inner cylindrical member 3, a front end of the hooking claw 5*a* of the hooking member 5 arranged in the end part of the movable inner cylindrical body 3 moves back against the force of the spring 13 while being in slide contact with the peripheral wall part of an end side of the crown cap A. Then, the crown cap A upwardly passes the hooking claw 5*a*, and as shown in FIG. 5, the top surface on the other side of the crown cap A is brought into contact with the projection 3*b* projecting from a lower end of the other end part of the top wall part 3*a* of the movable inner cylindrical member 3. The hooking claw 5*a* is then separated downward from the peripheral wall part of the crown cap A, and is engaged with the lower end of the end part of the crown cap A by the restoring force of the spring 13.

Figure 6:
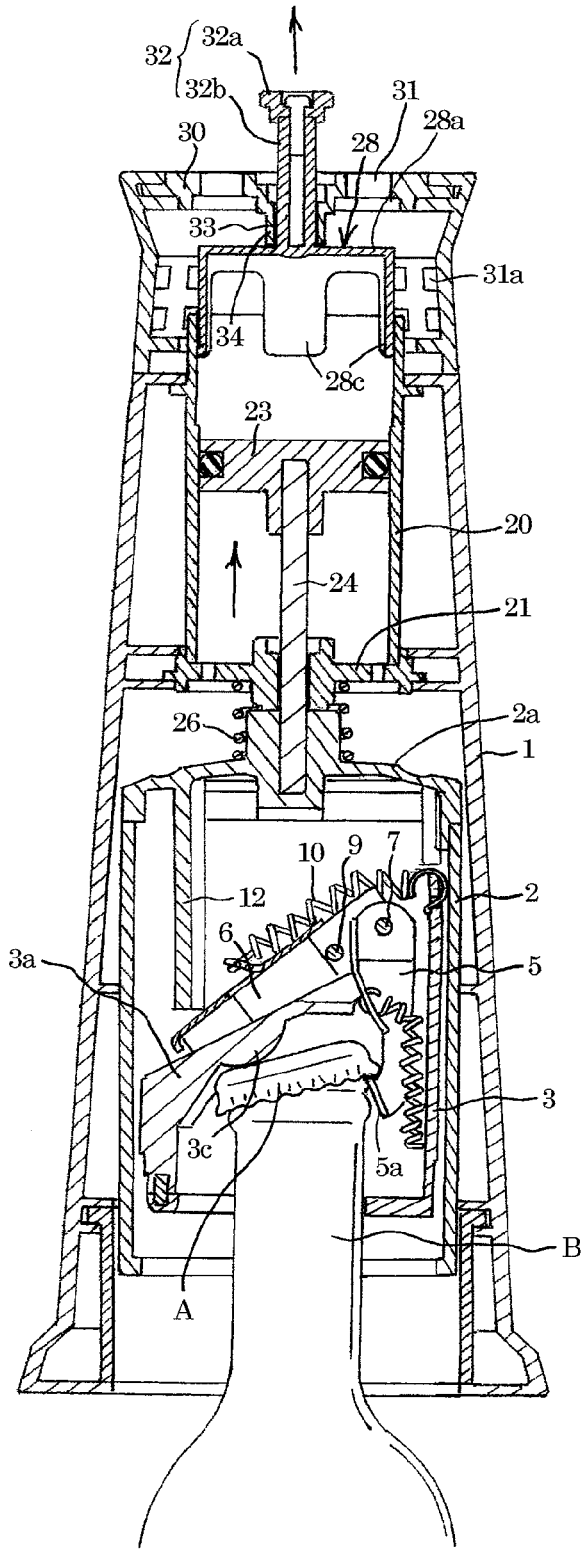
FIG. 6 is a vertically sectioned side view showing the state that the cover member comes out from the cylinder upon opening of the crown cap.

When the cylindrical main body 1 is pushed down further from this state, the cylinder 20 fitted in the upper half of the cylindrical main body 1 is moved down together with the cylindrical main body 1, and the movable outer cylindrical member 2 is urged downward by the elastic force of the coil spring 26 interposed between the bottom surface plate 21 of the cylinder 20 and the top wall part 2*a* of the movable outer cylindrical member 2, while the movable inner cylindrical member 3 is moved relatively upward and is pushed into the movable outer cylindrical member 2. The other end part side of the lever 6 is pushed down by the receiving member 12, which projects from the lower surface of the other end part of the top wall part 2*a* of the movable outer cylindrical member 2, against the elastic force of the tension spring 10 and around the pin 9 serving as a fulcrum, and an end part side moves upward and pulls up the hooking member 5, whereby, as shown in FIG. 6, the crown cap A is opened in a manner of being pried away from the bottle mouth B by the hooking claw 5*a* of the hooking member 5 according to the principle of leverage with the projection 3*c*, which projects from the end of the lower surface of the top wall part 3*a* of the movable inner cylindrical member 3, serving as a point of support.

Upon opening of the crown cap A, the resistance force of the crown cap A against the force of prying the crown cap A away from the bottle mouth B by the hooking claw 5*a* engaged with the lower end of the crown cap A works as a reaction force to push up the other end part of the lever 6, and the receiving member 12 of the movable outer cylindrical member 2 pressing the other end part of the lever 6 is urged upward and the movable outer cylindrical member 2 moves up while compressing the coil spring 26. The piston 23 joined to the movable outer cylindrical member 2 by the rod body 24 in an integrating manner is moved upward inside the cylinder 20 in a sliding manner, and the air in the upper half of the cylinder 20 closed by the cover member 28 is compressed.

As the compressed air pressure increases, the force of the receiving member 12 of the movable outer cylindrical member 2 pushing down the other end part side of the lever 6 increases and when the hooking member 5 is moved up having overcome the sealing resistance of the crown cap A, the crown cap A is pried away from the bottle mouth B as mentioned above. At the same time, the lower surface of the other end part of the lever 6 pushed down by the receiving member 12 is pressed against an inclined upper surface of the slope of the top wall part 3*a* of the movable inner cylindrical member 3. When the main body 1 is pushed down further from this state, the movable outer cylindrical member 2 is moved upward in an integrating manner by the intermediary of the movable inner cylindrical member 3 while maintaining the state of pressing the opened crown cap A against the projection 3*b* of the movable inner cylindrical member 3, and the piston 23 is moved up further by the intermediary of the rod body 24 to further compress the air in the upper half of the cylinder 20.

When the compressed air pressure increases beyond the frictional force between the cylinder 20 and the cover member 28, the cover member 28 is moved up in a moment. When the upper end of the leg elements 28*c* arranged on the lower end of the cover plate part 28*a* comes out of the upper end of the cylinder 20, the compressed air inside the cylinder 20 is discharged outside in a moment through the interval between mutually adjacent leg elements 28*c*, 28*c* while generating the "pop" sound which is comparable to the one generated when a champagne cork is pulled out. This sound comes out through the vent holes 31 formed in the outer peripheral part of the fixed top plate 30 closing the upper end opening part of the cylindrical main body 1 and a plurality of vent holes 31*a* formed in the upper end peripheral wall of the cylindrical main body 1, whereby the sound can be heard clearly.

When the upper portion of the cover member 28 is brought out of the upper end of the cylinder 20 by the compressed air pressure, the pushing-back member 32 moves upward together with the cover member 28, and the head part 32*a* at an upper end of the shaft part 32*b* projects upward from the supporting hole 33 formed in the center of the fixed top plate 30 of the cylindrical main body 1. When the cover member 28 is brought out of the upper end of the cylinder 20 to the extent that the upper end part of the leg elements 28*c* are also brought out of the same, the upper surface of the cover plate part 28*a* of the cover member 28 is brought into contact with the lower end surface of the stopper 34 arranged at the center part of the lower surface of the fixed top plate 30 in a downward projecting manner, whereby further upward movement is hindered, and most part of all the leg elements 28*c* of the cover member 28 is kept in the state of slide contact with the inner peripheral surface of the cylinder 20. The pushing-back member 32 is also kept in the state that the upper part of the shaft part 32*b* projects outside from the supporting hole 33 of the fixed top plate 30.

Figure 7:
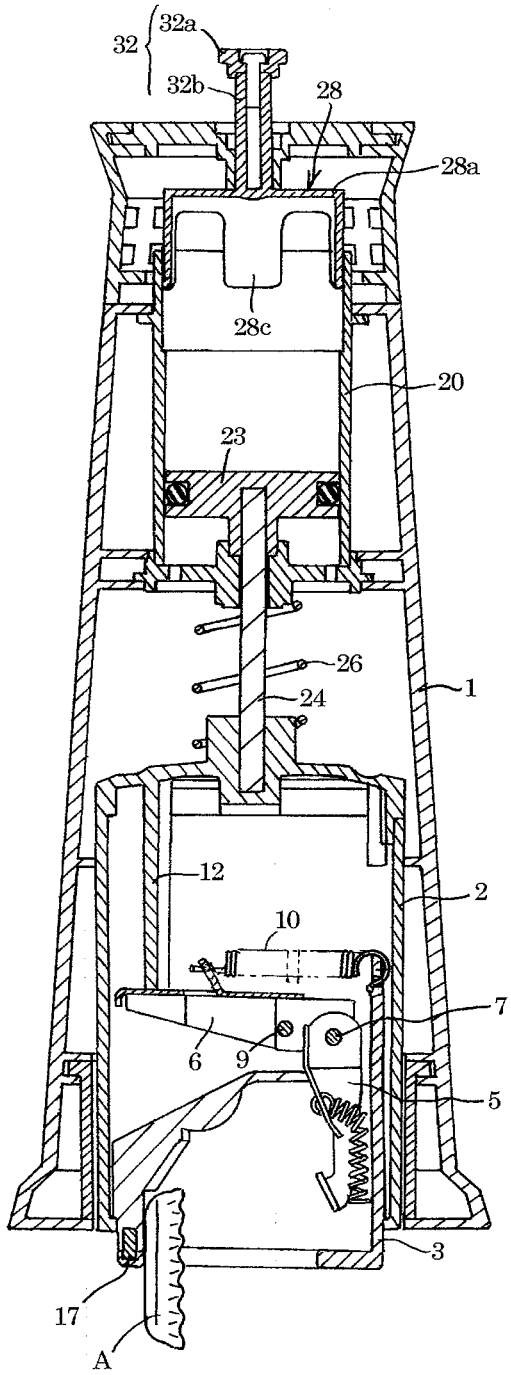
FIG. 7 is vertically sectioned side view showing the state that the bottle mouth is separated from the inside of the movable inner cylindrical member after opening of the crown cap.
Figure 8:
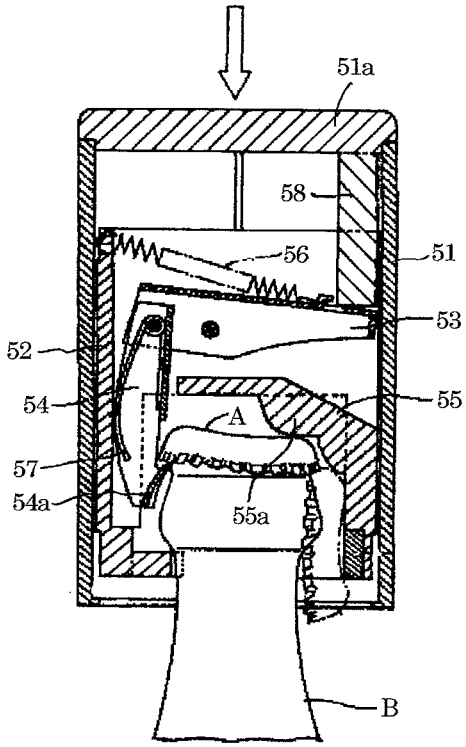
FIG. 8 is a vertically sectioned side view showing a structure of a conventional bottle cap opener.

When the cylindrical main body 1 is moved up from this state relatively to the bottle mouth B to separate the bottle mouth B downward from the movable inner cylindrical member 3, the other end part of the lever 6 abutting on the receiving member 12 of the movable outer cylindrical member 2 is rotated upward around the pin 9 by the restoring force of the tension spring 10. While the other end part of the lever 6 is rotated upward, the movable inner cylindrical member 3 which pivotally supports the pin 9 is pushed down. Then the hooking member 5 is restored to the initial state together with the lever 6, as shown in FIG. 7. At the same time, the movable outer cylindrical member 2 is also restored to the initial position by the restoring force of the coil spring 26.

After the bottle mouth B is separated from the cylindrical main body 1, the crown cap A pried off from the bottle mouth B passes a lower end opening part of the movable outer cylindrical member 2 together with the bottle mouth B, when the crown cap A is attracted and held by the magnet element 17 fitted to the lower end opening part.

In the meantime, the cover member 28 is kept in the state of being coming out upward from the cylinder 20, and the pushing-back member 32 is also kept in the state that the head part 32*a* projects upward from the fixed top plate 30. Consequently, when the head part 32*a* of the pushing-back member 32 is pressed to push down the pushing-back member 32, the cover member 28 is pushed into the cylinder 20 while being guided by the leg elements 28*c* which are in contact with the inside of the cylinder 20, and the cover member 28 including the cover plate part 28*a* is wholly inserted and fitted to the inner peripheral surface of the upper end part of the cylinder 20 to be restored to the initial closing state.

In the above-mentioned embodiment, the cover member 28 and the pushing-back member 32 are formed in an integrating manner, however, they may be formed separately. In this occasion, the lower end of the shaft part 32*b* of the pushing-back member 32 is made to abut on the center part of the upper surface of the cover member 28 in a freely contactable and separable manner.

The invention claimed is:

1. A bottle cap opener comprising:

a cylindrical main body, a movable outer cylindrical member arranged in a lower half of the cylindrical main body in a vertically movable manner, a movable inner cylindrical member arranged inside the movable outer cylindrical member in a vertically movable manner, provided with an opening part formed in a lower end thereof to receive a bottle mouth, and a top wall part having a projection receiving a top surface of the crown cap at an upper end thereof, a lever supported on the movable inner cylindrical member in a vertically swingable manner above the top wall part, a hooking member of which an upper end is pivotally fitted to an end of the lever in an inward and outward swingable manner and a lower end is provided with a hooking claw engageable with the crown cap, a receiving member arranged on the other end part side in the movable outer cylindrical member to receive an upper surface of the other end of the lever by a lower end surface thereof, a spring urging the other end part of the lever upward at all times and pressing the upper surface of the other end of the lever against the lower end surface of the receiving member, a cylinder arranged in the upper half of the cylindrical main body and having an open upper end, a piston fitted in the cylinder and moved up and down integrally with the movable outer cylindrical member, a cover member detachably fitted into an upper end opening part of the cylinder, brought out upward, when a frictional force between the cylinder and the cover member is overcome, by the pressure of the air inside the cylinder compressed by the piston which is moved upward upon opening operation of the crown cap, and generating a sound by letting the compressed air out from the inside of the cylinder when the cover member is brought out, and a spring urging the movable outer cylindrical member downward against the cylinder at all times.

2. The bottle cap opener claimed in claim 1, further comprising:

a rod body including an upper end part integrally fixed to a center part of a lower surface of the piston arranged in the cylinder in a vertically slidable manner, and a lower end part penetrating a center part of a bottom surface plate closing up a lower end opening part of the cylinder, and fixed to a top wall part of the movable outer cylindrical member, by which the piston and the movable outer cylindrical member are integrally connected with each other.

3. The bottle cap opener claimed in claim 1, wherein the cover member arranged in an upper end opening part of the cylinder comprises:

a cover plate part, a ring-shaped peripheral wall part projecting downward from an outer periphery of the cover plate part, and leg elements having a predetermined length and vertically arranged downward on a lower end of the ring-shaped peripheral wall part at predetermined intervals in a peripheral direction, in which an outer peripheral surface of the ring-shaped peripheral wall part and an outer surface of the leg elements are in tight contact with an inner peripheral surface of the upper end opening part of the cylinder under a predetermined frictional force.

4. The bottle cap opener claimed in claim 1, further comprising:

a fixed top plate fixed to an upper end opening part of the cylindrical main body having a plurality of vent holes formed in an outer peripheral part of the fixed top plate in a penetrating manner, and a short cylindrical stopper arranged on a lower surface of the fixed top plate in a projecting manner to receive the cover member coming out upward from the cylinder upon opening of the crown cap and to inhibit the whole cover member from separating upward from the cylinder.

5. The bottle cap opener claimed in claim 3, further comprising:

a fixed top plate fixed to an upper end opening part of the cylindrical main body having a plurality of vent holes formed in an outer peripheral part of the fixed top plate in a penetrating manner, and a short cylindrical stopper arranged on a lower surface of the fixed top plate in a projecting manner to receive the cover member coming out upward from the cylinder upon opening of the crown cap and to inhibit the whole cover member from separating upward from the cylinder.

6. The bottle cap opener claimed in claim 1 further comprising:

a pushing-back member arranged on an upper end of the cylindrical main body to fit the cover member coming out upward from the cylinder upon opening operation of the crown cap back into an upper end part of the cylinder, and a supporting hole formed in the center part of the fixed top plate for insertion and support of the pushing-back member in a vertically movable manner.

7. The bottle cap opener claimed in claim 3, further comprising:

a pushing-back member arranged on an upper end of the cylindrical main body to fit the cover member coming out upward from the cylinder upon opening operation of the crown cap back into an upper end part of the cylinder, and a supporting hole formed in the center part of the fixed top plate for insertion and support of the pushing-back member in a vertically movable manner.

8. The bottle cap opener claimed in claim 4, further comprising:

a pushing-back member arranged on an upper end of the cylindrical main body to fit the cover member coming out upward from the cylinder upon opening operation of the crown cap back into an upper end part of the cylinder, and a supporting hole formed in the center part of the fixed top plate for insertion and support of the pushing-back member in a vertically movable manner.

9. The bottle cap opener claimed in claim 1, wherein the pushing-back member comprises a head part fitted into the supporting hole formed in the center part of the fixed top plate of the cylindrical main body, a shaft part made to project its lower end from a lower surface of the head part downward through the stopper projecting from the lower surface of the fixed top plate, and a pressing contact plate fitted to the lower end of the shaft part and abutted on an upper surface of the cover member of the cylinder, in which a coil spring urging the pushing-back member downward at all times is interposed between the upper surface of the pressing contact plate and a lower face of the fixed top plate.

10. The bottle cap opener claimed in claim 3, wherein the pushing-back member comprises a head part fitted into the supporting hole formed in the center part of the fixed top plate of the cylindrical main body, a shaft part made to project its lower end from a lower surface of the head part downward through the stopper projecting from the lower surface of the fixed top plate, and a pressing contact plate fitted to the lower end of the shaft part and abutted on an upper surface of the cover member of the cylinder, in which a coil spring urging the pushing-back member downward at all times is interposed between the upper surface of the pressing contact plate and a lower face of the fixed top plate.

11. The bottle cap opener claimed in claim 4, wherein the pushing-back member comprises a head part fitted into the supporting hole formed in the center part of the fixed top plate of the cylindrical main body, a shaft part made to project its lower end from a lower surface of the head part downward through the stopper projecting from the lower surface of the fixed top plate, and a pressing contact plate fitted to the lower end of the shaft part and abutted on an upper surface of the cover member of the cylinder, in which a coil spring urging the pushing-back member downward at all times is interposed between the upper surface of the pressing contact plate and a lower face of the fixed top plate.

12. The bottle cap opener claimed in claim 5, wherein the pushing-back member comprises a head part fitted into the supporting hole formed in the center part of the fixed top plate of the cylindrical main body, a shaft part made to project its lower end from a lower surface of the head part downward through the stopper projecting from the lower surface of the fixed top plate, and a pressing contact plate fitted to the lower end of the shaft part and abutted on an upper surface of the cover member of the cylinder, in which a coil spring urging the pushing-back member downward at all times is interposed between the upper surface of the pressing contact plate and a lower face of the fixed top plate.

* * * * *